US006926615B1

(12) United States Patent
Souza et al.

(10) Patent No.: US 6,926,615 B1
(45) Date of Patent: Aug. 9, 2005

(54) GOLF PUTTER HEAD WITH INCREASED DIMENSIONS AND INCREASED MOMENT OF INERTIA

(75) Inventors: John C. Souza, Phoenix, AZ (US); Anthony D. Serrano, Peoria, AZ (US); John A. Solheim, Phoenix, AZ (US); David D. Jones, Glendale, AZ (US); Eric J. Morales, Phoenix, AZ (US); John P. Fife, Jr., Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 5 days.

(21) Appl. No.: 10/923,216

(22) Filed: Aug. 20, 2004

Related U.S. Application Data

(63) Continuation-in-part of application No. 10/837,860, filed on May 3, 2004.

(51) Int. Cl.[7] ..... A63B 53/06

(52) U.S. Cl. ..... 473/251; 473/313; 473/340; 473/335; 473/341; 473/338

(58) Field of Search ..... 473/334–339, 473/340–341, 251–256, 305–315, 324; D21/736–746

(56) References Cited

U.S. PATENT DOCUMENTS

| | | | | | |
|---|---|---|---|---|---|
| D58,209 | S | | 6/1921 | Bacheller | |
| 2,056,335 | A | * | 10/1936 | Wettlaufer | 473/245 |
| D163,083 | S | | 5/1951 | Belline | |
| 2,954,231 | A | | 9/1960 | MacIntyre | |
| 3,143,349 | A | * | 8/1964 | MacIntyre | 473/338 |
| D230,869 | S | | 3/1974 | Winter | |
| D234,960 | S | | 4/1975 | Swash | |
| D235,668 | S | | 7/1975 | Swash | |
| 3,966,210 | A | * | 6/1976 | Rozmus | 473/341 |
| 4,010,958 | A | * | 3/1977 | Long | 473/341 |
| D255,373 | S | | 6/1980 | Solheim | |
| 4,213,613 | A | * | 7/1980 | Nygren | 473/327 |
| 4,444,395 | A | | 4/1984 | Reiss | |
| D281,178 | S | | 10/1985 | Brockenshire | |
| D282,952 | S | | 3/1986 | Mattingly | |
| 4,815,739 | A | | 3/1989 | Donica | |
| 4,867,458 | A | * | 9/1989 | Sumikawa et al. | 473/336 |
| 4,869,507 | A | * | 9/1989 | Sahm | 473/337 |
| 5,116,047 | A | * | 5/1992 | Phelan et al. | 473/307 |
| 5,160,141 | A | | 11/1992 | Crews | |
| 5,213,332 | A | | 5/1993 | Fahy et al. | |
| D341,405 | S | | 11/1993 | Solheim | |
| 5,482,281 | A | | 1/1996 | Anderson | |

(Continued)

*Primary Examiner*—Sebastiano Passaniti
(74) *Attorney, Agent, or Firm*—Darrell F. Marquette

(57) ABSTRACT

A golf putter head with a heel end and a toe end includes a face member arranged for impacting a golf ball. A rear member extends in an arcuate path from one end of the face member to the other end of the face member. The face member and the rear member are made of a low density material such as carbon fiber. A first plurality of three weight members is disposed in the rear member, and each of these three weight members is each made of high density material, such as tungsten. A second plurality of two weight members is disposed in the face member, and each of these weight members is also made of high density material.

17 Claims, 5 Drawing Sheets

U.S. PATENT DOCUMENTS

| | | | | |
|---|---|---|---|---|
| D379,484 | S | 5/1997 | Solheim | |
| 5,630,765 | A | 5/1997 | Moore | |
| D380,029 | S | 6/1997 | Anderson | |
| 5,746,664 | A * | 5/1998 | Reynolds, Jr. | 473/252 |
| D399,911 | S | 10/1998 | Nicolette et al. | |
| 5,830,078 | A | 11/1998 | McMahan | |
| D402,722 | S | 12/1998 | Rollinson | |
| 5,842,935 | A | 12/1998 | Nelson | |
| D405,137 | S | 2/1999 | Nelson | |
| D410,717 | S | 6/1999 | Anderson | |
| D411,271 | S | 6/1999 | Nelson | |
| 6,059,669 | A | 5/2000 | Pearce | |
| 6,080,070 | A | 6/2000 | Whitley | |
| D449,865 | S | 10/2001 | Fife, Jr. et al. | |
| D451,973 | S | 12/2001 | Wells et al. | |
| 6,350,208 | B1 | 2/2002 | Ford | |
| D460,990 | S | 7/2002 | Jung | |
| 6,796,911 | B2 * | 9/2004 | Grace | 473/251 |
| D499,778 | S * | 12/2004 | Cameron | D21/742 |
| 6,837,801 | B1 * | 1/2005 | Souza et al. | 473/251 |
| 2004/0138003 | A1 * | 7/2004 | Grace | 473/334 |
| 2004/0166953 | A1 * | 8/2004 | Grace | 473/251 |

* cited by examiner

GOLF PUTTER HEAD WITH INCREASED DIMENSIONS AND INCREASED MOMENT OF INERTIA

This is a continuation-in-part of application Ser. No. 10/837,860 filed May 3, 2004.

BACKGROUND OF THE INVENTION

This invention relates generally to golf equipment and, in particular, to a golf putter head with increased dimensions and increased moment of inertia.

Recent developments in golf equipment have resulted in golf putter heads with high moments of inertia. For example, U.S. Pat. No. 5,482,281 to D. W. Anderson discloses a putter head sold under the name DANSER. The Anderson putter head has heel and toe weights mounted on a lower plate-like member. The heel and toe weights and the lower plate-like member are preferably made of heavyweight material such as bronze or steel. An upper shell-like member, preferably made of lightweight material such as plastic or aluminum, is secured to the lower plate-like material to enclose the heel and toe weights. U.S. Pat. No. 5,842,935 to M. J. Nelson discloses a putter head sold under the name NELLI. The Nelson putter head has a horseshoe shaped body formed of high density material such as steel with thickened heel and toe portions. The horseshoe shaped body includes a cavity which receives an insert formed of low density material such as polyurethane. The insert preferably constitutes about 15% of the total weight of the putter head while constituting more than 50% of the total volume of the putter head.

SUMMARY OF THE INVENTION

The present invention provides a golf putter head having a heel end and a toe end. The golf putter head includes a face member with a front surface arranged for impacting a golf ball, and a rear member extending in an arcuate path from one end to the other end of the face member. The face member and the rear member are made of low density material, preferably a non-metallic material such as carbon fiber. A first plurality of weight members is disposed in the rear member with these weight members each being made of high density material, preferably a metallic material such as tungsten, which is substantially denser than the low density material. In the preferred embodiment of the golf putter head, the first plurality of weight members comprises a weight member located adjacent the putter head heel end, another weight member located adjacent the putter head toe end, and a further weight member located intermediate the putter head heel and toe ends. A second plurality of weight members may be disposed in the face member and comprises two weight members made of high density material with one of the weight members located adjacent one end of the face member and the other weight member located adjacent the other end of the face member.

DESCRIPTION OF THE INVENTION

Figure 1:
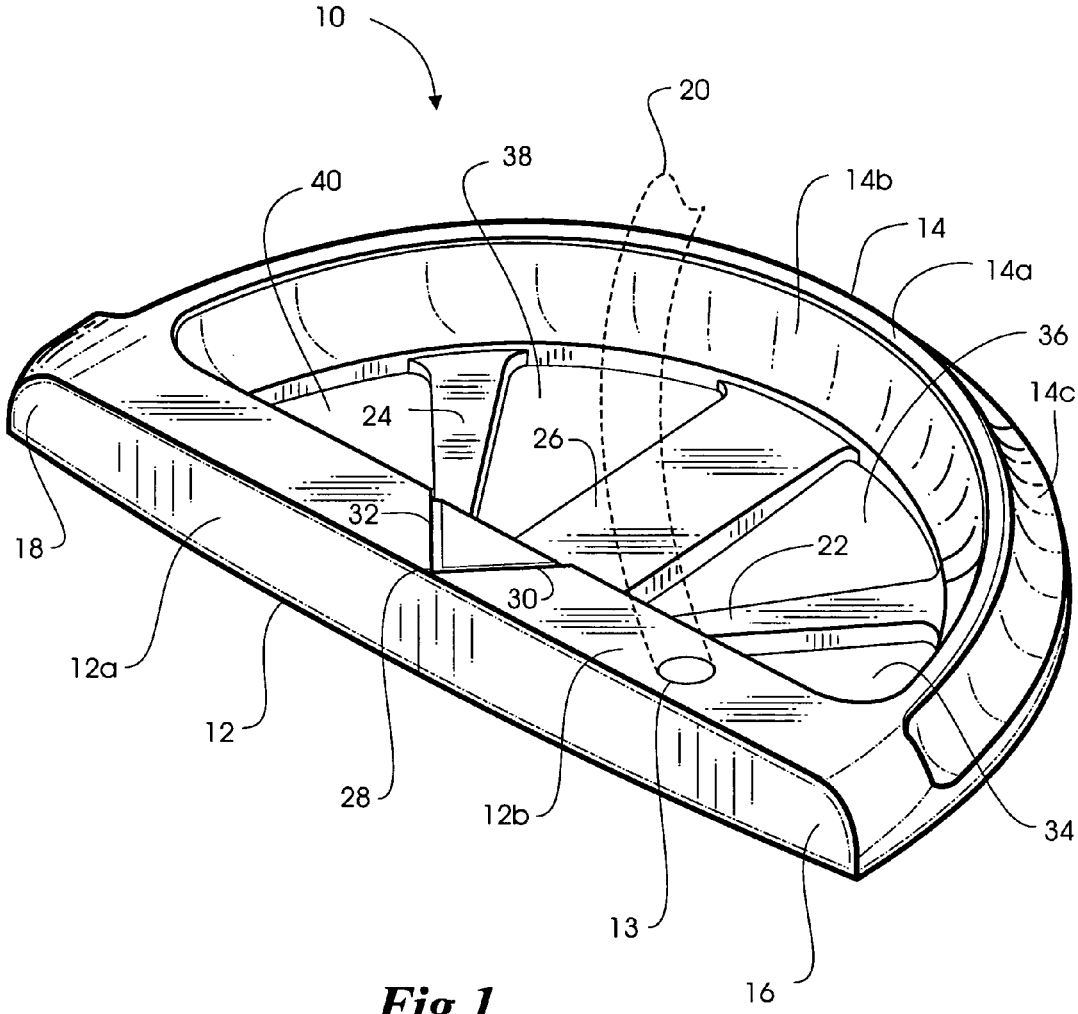
FIG. 1 is a perspective view of a golf putter head according to one embodiment of the present invention.
Figure 2:
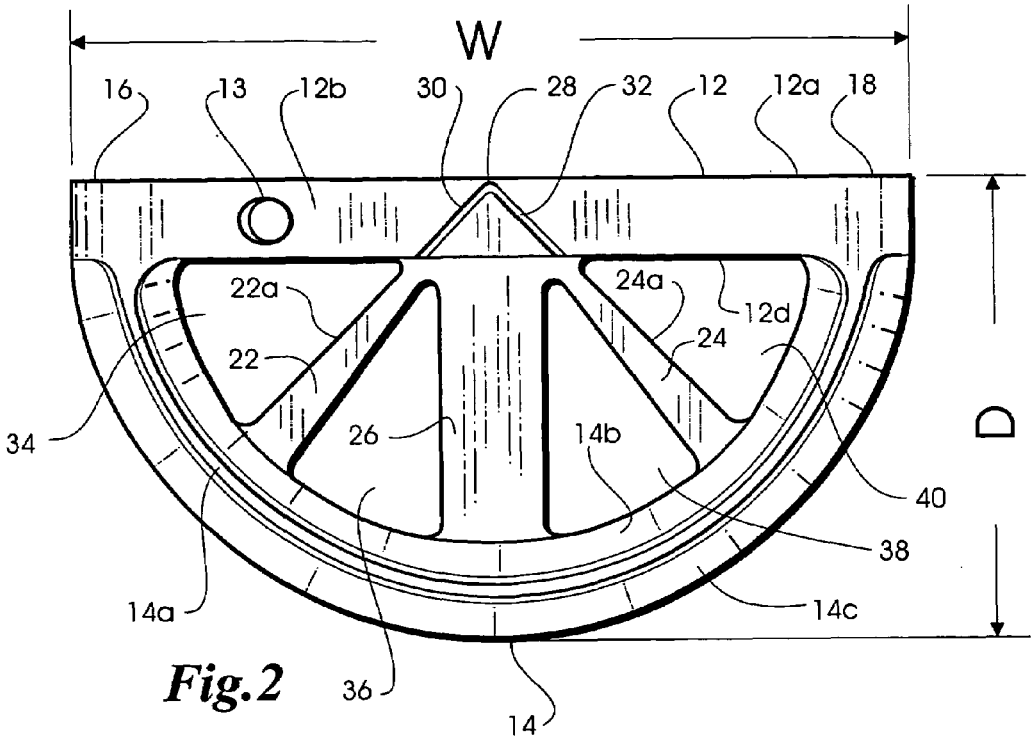
FIG. 2 is a top plan view of the golf putter head shown in FIG. 1.
Figure 3:
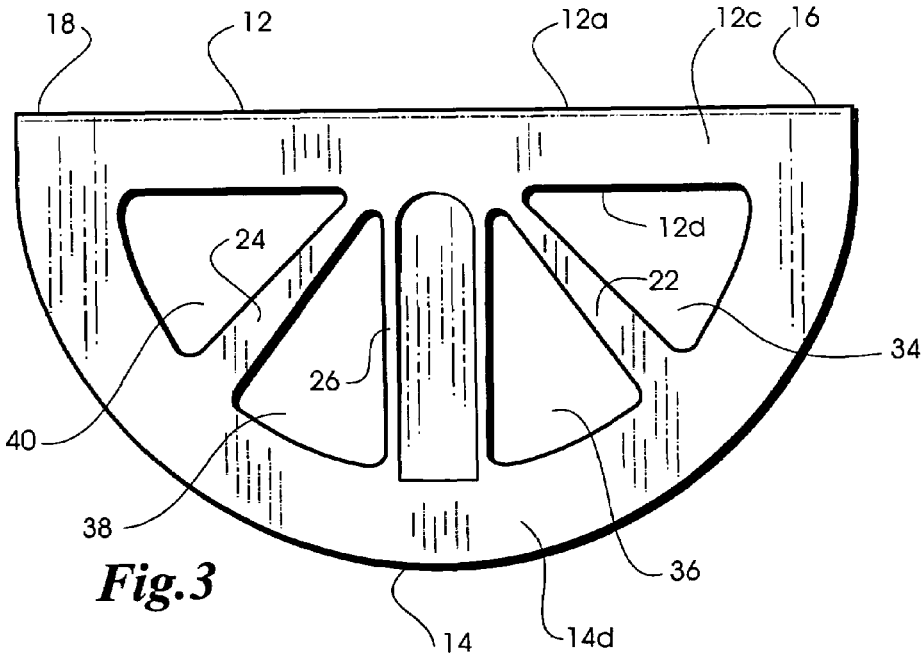
FIG. 3 is a bottom view of the golf putter head shown in FIG. 1.

Referring to FIG. 1, a golf putter head 10 includes a face member 12 and a rear member 14. The rear member 14 extends in an arcuate path of substantially 180 degrees from a heel end 16 of the face member 12 to a toe end 18 of the face member 12. The face member 12 has a front surface 12*a* arranged for impacting a golf ball, an upper surface 12*b* with a hole 13 formed therein for receiving a shaft 20, a lower surface 12*c* located opposite the upper surface 12*b*, and a back surface 12*d* located opposite the front surface 12*a*. The rear member 14 has an upper surface 14*a*, an inner surface 14*b*, an outer surface 14*c* and a lower surface 14*d*. The upper and lower surfaces 14*a*, 14*d* of the rear member 14 are located opposite each other, and the inner and outer surfaces 14*b*, 14*c* of the rear member 14 are located opposite each other.

The golf putter head 10 further includes a first strut 22, a second strut 24 and a third strut 26. The first and second struts 22, 24 extend from the rear member 14 to the face member 12 and converge toward each other as they approach the face member 12. A generally V-shaped marking 28 is provided on the upper surface 12*b* of the face member 12 between the heel and toe ends 16, 18. The V-shaped marking 28 has one leg 30 thereof aligned with an edge 22*a* of the first strut 22 and another leg 32 thereof aligned with an edge 24*a* of the second strut 24. The third strut 26 also extends from the rear member 14 to the face member 12 and lies between the first and second struts 22, 24.

It will be understood that the putter head 10 is preferably made of lightweight material such as aluminum or titanium so that it will have increased dimensions. For example, the putter head 10 may have a width W of between 4.0 and 12.0 inches, preferably 9.0 inches, measured between the heel end 12*a* and the toe end 12*b* of the face member 12. Also, the putter head 10 may have a depth D of between 2.0 and 6.0 inches, preferably 4.5 inches, measured between the front surface 12*a* of the face member 12 and the outer surface 14*a* of the rear member 14. These dimensions for the width W and depth D provide the putter head 10 with an increased moment of inertia.

The first, second and third struts 22, 24 and 26 are connected to the back surface 12*d* of the face member 12 and to the inner surface 14*b* of the rear member 14 and are arranged to define four triangularly shaped open spaces 34, 36, 38 and 40 between the face member 12 and the rear member 14. Open spaces 34 and 40 are of identical size while open spaces 36 and 38 are of identical size. The open spaces 34, 36, 38 and 40 allow the putter head 10 to have the increased dimensions described above without exceeding a desired weight of approximately 350 to 500 grams.

Figure 4:
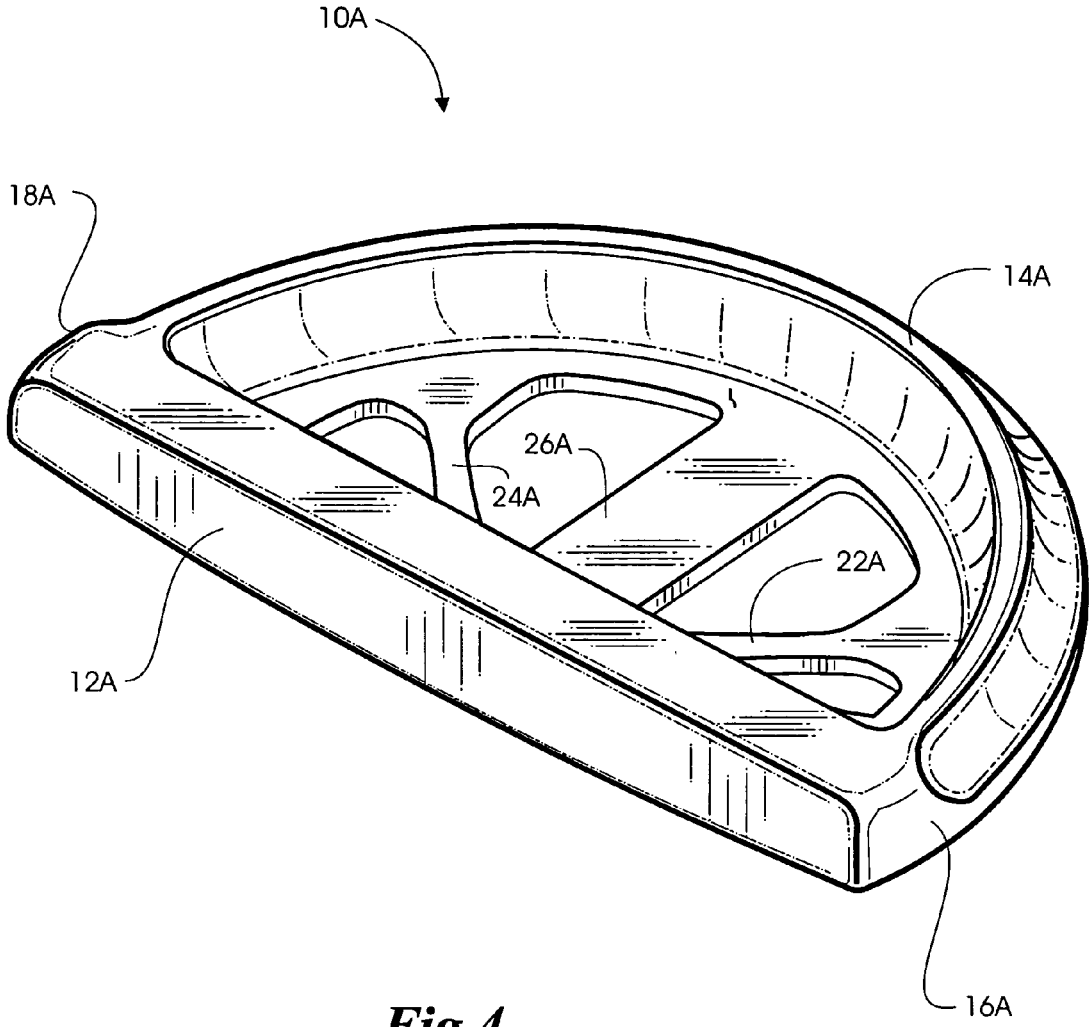
FIG. 4 is a perspective view of a golf putter head according to another embodiment of the present invention.
Figure 5:
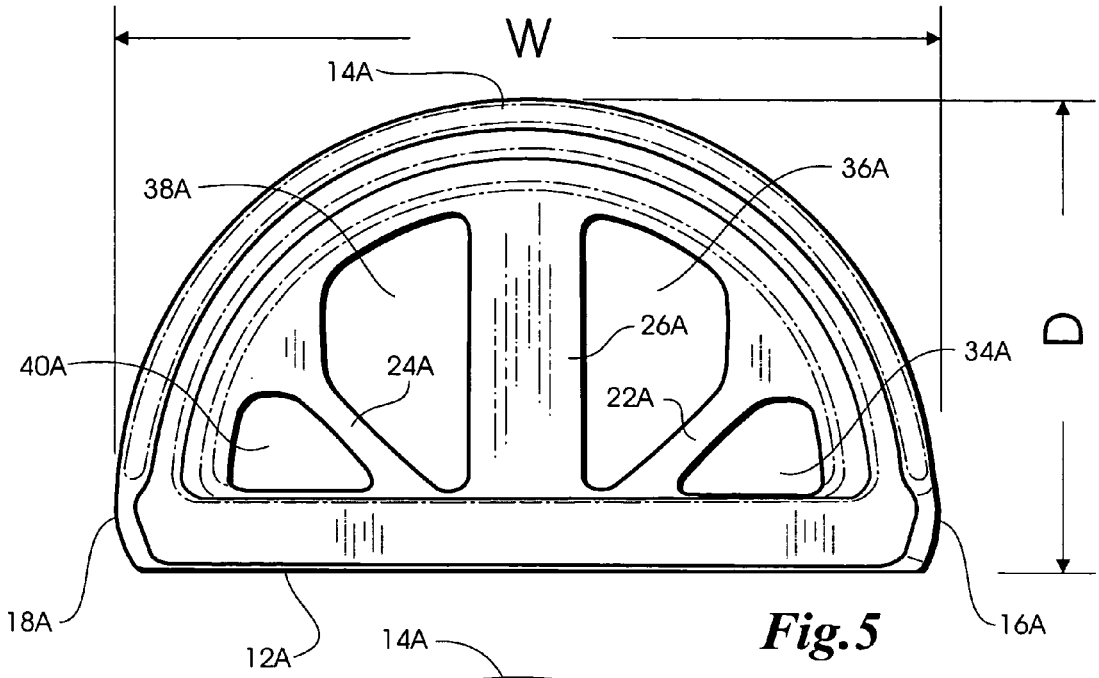
FIG. 5 is a top plan view of the golf putter head shown in FIG. 4.
Figure 6:
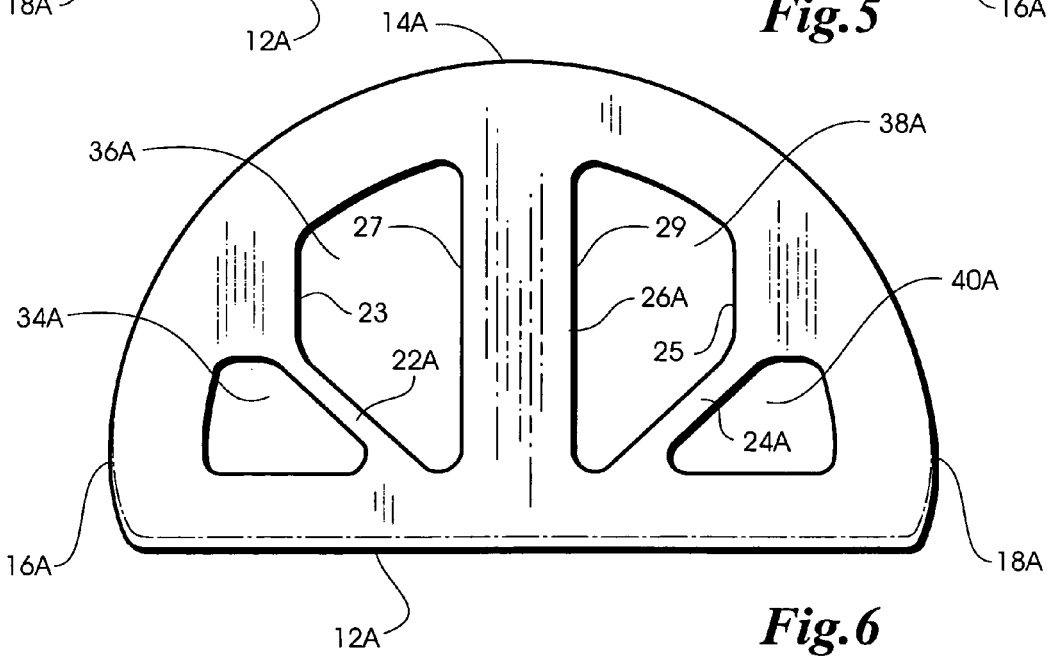
FIG. 6 is a bottom view of the golf putter head shown in FIG. 4.

Referring to FIGS. 4–6, a golf putter includes a putter head 10A similar to the putter head 10 shown in FIG. 1. Putter head 10A has a face member 12A, a rear member 14A, a heel end 16A and a toe end 18A. First, second and third struts 22A, 24A and 26A extend between and are connected to the face and rear members 12A, 14A. These struts 22A, 24A, 26A are arranged to define four substantially trapezoid shaped open spaces 34A, 36A, 38A and 40A between the face member 12A and the rear member 14A. The first strut 22A has an edge portion 23 arranged generally parallel to one edge 27 of the third strut 26A, and the second strut 24A has an edge portion 25 arranged generally parallel to the opposite edge 29 of the third strut 26A.

The putter head 10A preferably has a maximum width W measured between its heel and toe ends 16A, 18A as seen in FIG. 5 of at least 15 centimeters and a maximum depth D that is at least equal to ½ width W. In the preferred embodiment of the putter head 10A, the maximum width W is 17 centimeters and the maximum depth D is 10 centimeters. This results in the putter head 10A having a maximum moment of inertia with extreme perimeter weighting.

Figure 7:
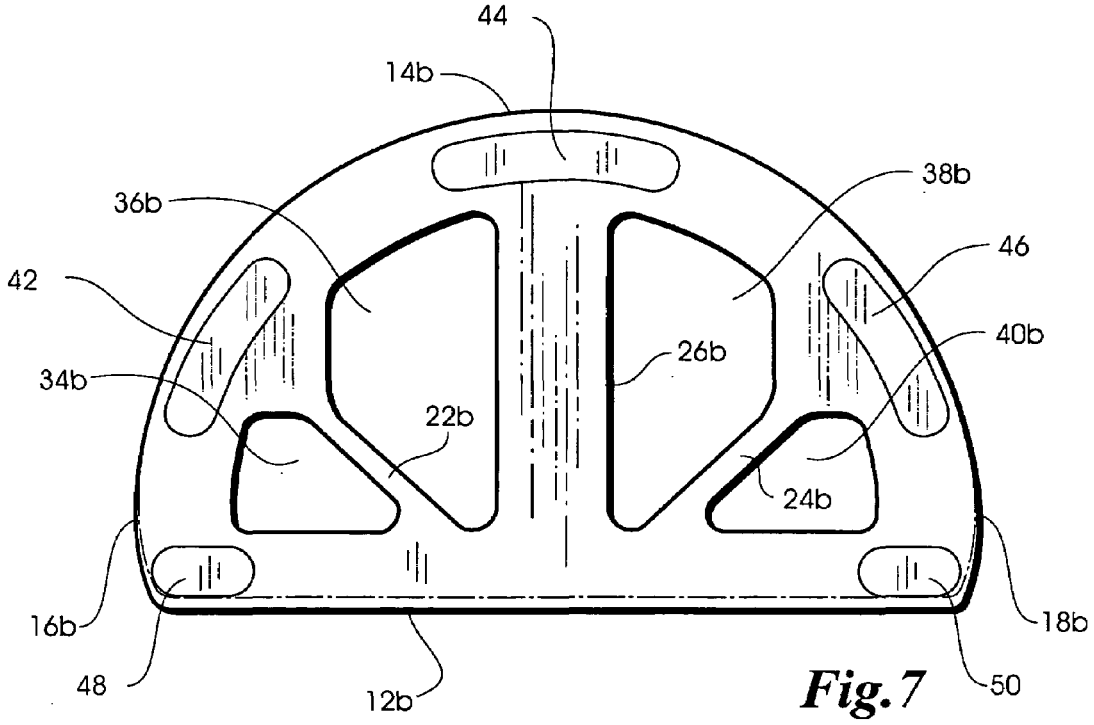
FIG. 7 is a bottom view of a golf putter head according to a further embodiment of the present invention.

Referring to FIG. 7, a golf putter head 10B with a heel end 16B and a toe end 18B is similar to the golf putter head 10A. The putter head 10B includes a face member 12B and a rear member 14B. Struts 22B, 24B and 26B extending between and connected to the face member 12B and the rear member 14B define open spaces 34B, 36B, 38B, 40B that are substantially trapezoid shaped. In this embodiment, the face member 12B, the rear member 14B and the struts 22B, 24B, 26B are made of low density material which is preferably a non-metallic material such as carbon fiber. The face member 12B, the rear member 14B and the struts 22B, 24B, 26B in combination weigh approximately 190 grams.

A first plurality of three weight members 42, 44, 46 is disposed in the rear member 14B. The weight member 42 is located adjacent the heel end 16B, the weight member 44 is located adjacent the toe end 18B, and the weight member 46 is located intermediate the heel and toe ends 16B, 18B. The weight members 42, 44, 46 are made of high density material, which is preferably a metallic material such as tungsten, that is substantially denser than the low density material described above. Each of the weight members 42, 44, 46 weighs approximately 40 grams.

A second plurality of two weight members 48, 50 is disposed in the face member 12B. Weight member 48 is located adjacent one end of the face member 12B, and weight member 50 is located adjacent the other end of the face member 12B. The weight members 48, 50 are made of high density material, preferably the same high density material the weight members 42, 44, 46 are made of. Each of the weight members 48, 50 weighs approximately 25 grams.

It will be understood that, while the weight members 42, 44, 46 further increase the moment of inertia of the putter head 10B, they also move the putter head center of gravity away from the face member 12B. However, when the weight members 48, 50 are added, they shift the putter head center of gravity back toward the face member 12B. Therefore, the putter head 10B has high moment of inertia and preferred center of gravity location.

What is claimed is:

1. A golf putter head having a heel end and a toe end, said golf putter head comprising:

a face member including a front surface arranged for impacting a golf ball;

a rear member extending in an arcuate path from one end to the other end of said face member;

said face member and said rear member being made of low density material;

a first plurality of weight members disposed in said rear member, each weight member in said first plurality of weight members being made of high density material;

a second plurality of weight members disposed in said face member, each weight member in said second plurality of weight members also being made of high density material;

said second plurality of weight members including two weight members with one of the weight members located adjacent said one end of said face member and the other weight member located adjacent said other end of said face member.

2. The golf putter bead of claim 1, wherein said first plurality of weight members comprises three weight members with one weight member located adjacent said heel end, another weight member located adjacent said toe end, and a further weight member located intermediate said heel and toe ends.

3. The golf putter head of claim 1, wherein said low density material is a non-metallic material.

4. The golf putter head of claim 3, wherein said non-metallic material is carbon fiber.

5. The golf putter head of claim 4, wherein said high density material is a metallic material.

6. The golf putter head of claim 5, wherein said metallic material is tungsten.

7. The golf putter head of claim 1, wherein said arcuate path extends substantially 180 degrees.

8. The golf putter head of claim 1, further comprising first and second struts extending between and connected to said rear member and said face member, said first and second struts converging toward each other as they approach said face member.

9. The golf putter head of claim 8, further comprising a third strut extending between and connected to said rear member and said face member, said third strut lying between said first and second struts.

10. The golf putter head of claim 9, wherein said first, second and third struts are arranged to define four substantially trapezoid shaped open spaces between said face member and said rear member.

11. The golf putter head of claim 9, wherein said face member, said rear member, and said first, second and third struts in combination weigh approximately 190 grams.

12. The golf putter head of claim 11, wherein the three weight members of said plurality of weight members each weigh approximately 40 grams.

13. The golf putter head of claim 12, wherein the two weight members of said another plurality of weight members each weigh approximately 25 grams.

14. A golf putter head having a heel end and a toe end, said golf putter head comprising:

a face member including a front surface arranged for impacting a golf ball;

a rear member extending in an arcuate path from one end to the other end of said face member;

said face member and said rear member being made of low density material;

a first plurality of weight members disposed in said rear member and including one weight member located adjacent said heel end, another weight member located adjacent said toe end, and a further weight member located intermediate said heel and toe ends;

said weight members of said first plurality of weight members being made of high density material; and a second plurality of weight members disposed in said face member, said second plurality of weight members including two weight members made of high density material with one of the weight members located adjacent said one end of said face member and the other weight member located adjacent said other end of said face member.

15. The golf putter head of claim 14, wherein said low density material is a non-metallic material and wherein said high density material is a metallic material.

16. The golf putter head of claim 15, wherein said non-metallic material is carbon fiber and wherein said metallic material is tungsten.

17. The golf putter head of claim 14, further comprising:

first and second struts extending between and connected to said rear member and said face member, said first and second struts converging toward each other as they approach said face member; and a third strut extending between and connected to said rear member and said face member, said third strut lying between said first and second struts.

* * * * *